United States Patent [19]

Hayden, Jr.

[11] 4,446,635

[45] May 8, 1984

[54] ICE-CREEPER TYPE OVERSHOE

[76] Inventor: Donald W. Hayden, Jr., 1811 Dixon Rd., Baltimore, Md. 21209

[21] Appl. No.: 485,427

[22] Filed: Apr. 15, 1983

[51] Int. Cl.[3] ..... A43B 5/00; A43C 15/10; A43C 15/06

[52] U.S. Cl. ..... 36/116; 36/59 R; 36/59 C; 36/124; 36/7.6

[58] Field of Search ..... 36/7.6, 7.7, 2.6, 25 R, 36/59 C, 103, 116, 59 R, 124, 14, 16, 59 A, 59 B

[56] References Cited

U.S. PATENT DOCUMENTS

| | | | |
|---|---|---|---|
| 281,209 | 7/1883 | Street | 36/59 |
| 2,494,692 | 1/1950 | Craven | 36/59 |
| 3,258,859 | 7/1966 | Lamont et al. | 36/59 |
| 3,573,155 | 3/1971 | Mitchell | 161/168 |
| 3,597,863 | 8/1971 | Austin | 36/59 |
| 4,068,395 | 1/1978 | Senter | 36/14 |
| 4,160,331 | 7/1979 | Bell | 36/59 B |

FOREIGN PATENT DOCUMENTS

| | | | |
|---|---|---|---|
| 728174 | 6/1932 | France | 36/59 A |
| 272973 | 6/1927 | United Kingdom | 36/7.6 |

*Primary Examiner*—Werner H. Schroeder
*Assistant Examiner*—Steven N. Meyers
*Attorney, Agent, or Firm*—John F. McClellan, Sr.

[57] ABSTRACT

An article of footwear for walking on sheet ice and the like without slipping has self-deicing non-skid sole structure comprising a conventional flexible sole with a flexible aluminum flyscreen substantially loose covering over it, secured around the periphery of the sole; for preventing slipping on hard, smooth tile floors and the like are two other features, either or both of which may be provided: soft "Silicone" type rubber pads adhering to and flexing with selected portions of the flexible aluminum flyscreen loose covering for traction on such hard surfaces and also an all around downward projection of a soft trim strip of "Silicone" type rubber for the same purpose.

10 Claims, 5 Drawing Figures

ICE-CREEPER TYPE OVERSHOE

FIELD OF THE INVENTION

This invention relates generally to footwear and particularly to anti-slip sole provision.

BACKGROUND OF THE INVENTION

Many U.S. patents have disclosed provisions intended to prevent slipping on icy surfaces and the like, including the following:

U.S. Pat. No. 281,209 to S. M. Street, 7-10-82, showed a wire-strung shoe sole designed as an anti-wear device;

U.S. Pat. No. 2,494,692 to W. S. Craven, 1-17-50 showed detachable anti-slip equipment for a shoe;

U.S. Pat. No. 3,258,859 to J. F. Lamont and T. P. Gormley, 7-5-66, showed a grid in a shoe heel of plastic;

U.S. Pat. No. 3,574,155 to W. A. Mitchell, 3-30-71, showed a soft rubber sole impregnated with metallic particle;

U.S. Pat. No. 3,597,863 to M. L. Austin, 8-10-71, showed a sole with screen reinforcement inside.

SUMMARY OF THE INVENTION

Although the above and many other patents dealing with the subject are known to exist, no device of the types disclosed is known to have become the standard of commerce, for whatever reason or combination of reasons: lack of efficiency, cost, marring of floors, slippage on hard tile surfaces, weight, complexity, lack of durability, objectionable appearance.

A principal object of this invention is to provide a non-slip sole, embodied in an overshoe or other footwear that flexes when the wearer walks, which overcomes all the above deficiencies and which, it is hoped, will become the standard of commerce for the purpose.

Further objects are to provide a device as described which is eay to use, easily put on, taken off and stored, which inflicts little or no damage to floors and rugs, which flexes and is comfortable to walk in, which is durable enough for repeated use under hazardous conditions, which is inexpensive, requires no extra effort in walking, which is compact, and which makes walking on ice almost safe.

Ice is hazardous for walking; broken bones, concussions and even incapacitation followed by freezing to death are recognized hazards from falls caused by ice underfoot.

The inventor has tested the invention in secret and found that on ice he can walk without slipping, can run and stop normally and can even bound up ice-covered steps. The invention can be worn for extended intervals without losing efficiency when chilled.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
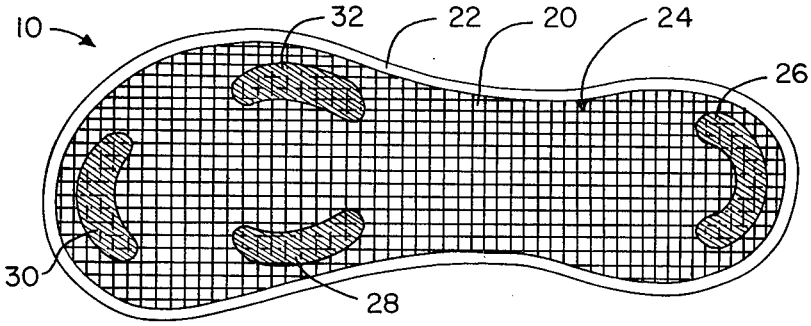
FIG. 1 is a bottom plan view of footwear having a sole according to this invention.

FIG. 1 shows the invention 10 as viewed incorporated in the bottom of flexible footwear, preferably but not necessarily of the overshoe type. The footwear has a sole 20 and a trim ring 22 around the upright sides of the sole. Exposed over substantially the entire bottom of the sole is a loose covering of ordinary flexible aluminum flyscreen 24 held at the periphery, around which the trim ring 22 is installed. The flyscreen flexes somewhat as the wearer walks in response to flexing of the footwear but tends to follow the contour of the backing material or sole of the footwear, and for some reason tends to shed any ice or snow picked up and which might otherwise cling to it. There seems to be some ice-shearing flyscreen flexure in the plane of the flyscreen.

Walking, for whatever reason, effectively renews the traction at almost every normal step, so that even sheet ice can be navigated with confidence. The high thermal conductivity of the aluminum may be a factor in the surprising free-shedding ice-biting action, which has not been thoroughly understood. Stiffness of the weave structure and locus of attachment seem to contribute. Clearance between flyscreen and backing material may be a factor; on installation and after wear the flyscreen may be in contact with the backing material. If there is more than a millimeter or two of clearance at the heel, there may be an undesirable build-up of ice there, on loosely structured ice, but not otherwise.

"The self-cleaning process in this invention works in the following manner. When pressure is applied to the mesh part of the device, the ice or snow under the device conforms to the pattern of the mesh, but does not protrude through the mesh to the point where it would be trapped on the reverse side of the mesh. Also the fact that the wire is round, would have a tendency to shape the intruding ice or snow into small flat topped pyramids, which would easily release from the mesh. So, when the average step is taken by the wearer of the device, the mesh is forced against the icy surface and conforms to the shape of the terrain much like a soft shoe sole. At this point, the device has its maximum tractive surface in contact with the ice. In the walking process, as ones weight is shifted forward and the pressure is released progressively from the rear, the mesh is peeled, then lifted from the ice and follows the contour of the backing substance or sole of the device. At this point in time the device is free from any ice or snow that would impair its effectiveness, and is ready for continued cycling which would occur in the walking process."

"Also, another fact that must be considered is that when snow or ice is compressed, as when one compresses snow to make a snowball, the more that the snow is compressed the more it maintains its integrity as a body and the less it is apt to be affected by contact with foreign objects. This principle is easily demonstrated when one makes a snowball with a pair of gloves on; the gloves apply direct pressure to the snow, compressing and shaping it to a hard firm shape (hopefully a sphere). During the process the gloves have had repeated contact with the snow, but for all practical purposes have not picked up any snow. So it seems that snow and ice are not attracted to the mesh on the device, in much the same way that they are not attracted to the gloves. Therefore it seems that the pull of the foreign objects stated, when removed from ice or snow is not great enough to overcome the forces holding the ice or snow together. This is probably the primary reason that the mesh in the device cleans itself so well."

The invention includes means on the substantially loose covering of aluminum flyscreen for maintaining traction on smooth, hard tile floors and the like, comprising soft elastomeric material embedded upon and protruding downwardly from a plurality of areas of said substantially loose covering of aluminum flyscreen. The soft elastomeric material is of non-cold-hardening material; that is, of material that remains soft when cold, such as "Silicone" rubber. It is free of attachment to the bottom of the sole. The plurality of areas at which the soft elastomeric material is located are designated at 26, 28, 30, 32; 26 is an arcuate area adjacent the heel area of the sole and 30 is an area adjacent the toe area of the sole. The trim ring 22 is of soft elastomeric material, and protrudes downwardly below the substantially loose covering of aluminum flyscreen.

Figure 2:
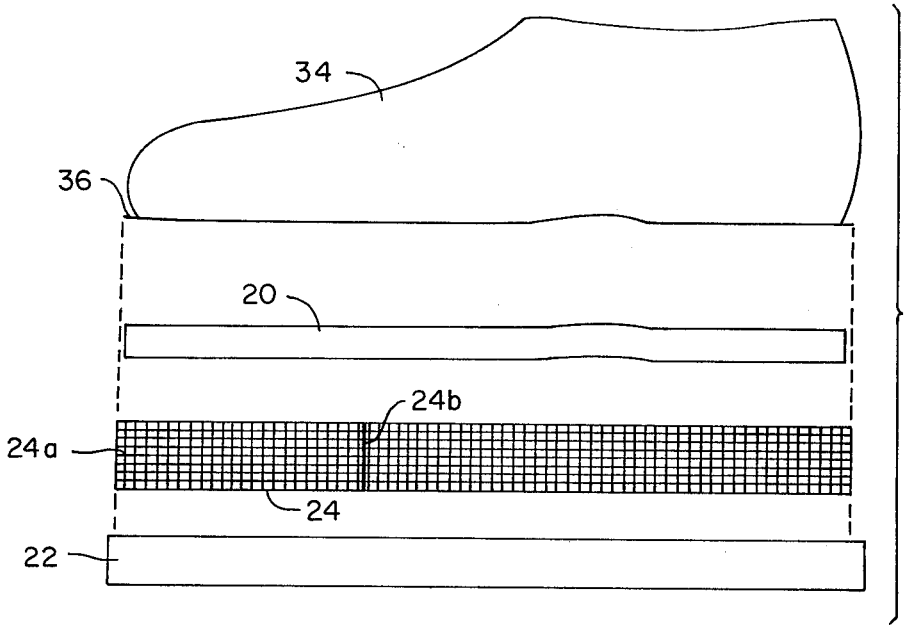
FIG. 2 is an exploded view showing relation of the parts thereof.

Referring to FIG. 2, the flexible but firm sole 20 may be of rubber or thermoplastic and perhaps ¼ inch (6 mm) thick. For assembly, this is laid on a piece of the flexible aluminum flyscreen material 24.

The flexible aluminum flyscreen connective portions of material, 24*a* are then folded up around the edges of the sole, with slits 24*b* and/or removal of "V"-segments as needed to fit the upstanding sides over and onto the top of the sole. It may be cemented on the top of the sole 20 and then the sole cemented at the same time to the bottom of the vamp 34.

Finally, the flap 36 may be captured inside the trim ring 22 which is at the same time cemented to it and around the vertical edges of the sole 20 and the screening covering the vertical edges of the sole.

Figure 3:
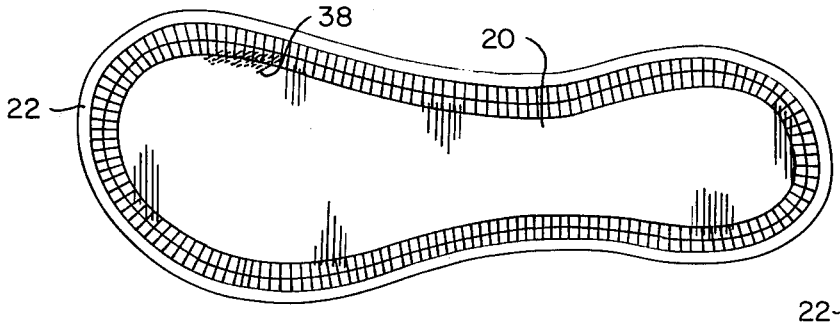
FIG. 3 is a top plan view adapted from 3—3, FIG. 4, of the sole of the footwear with trim ring expanded slightly, in a stage of assembly.
Figure 4:
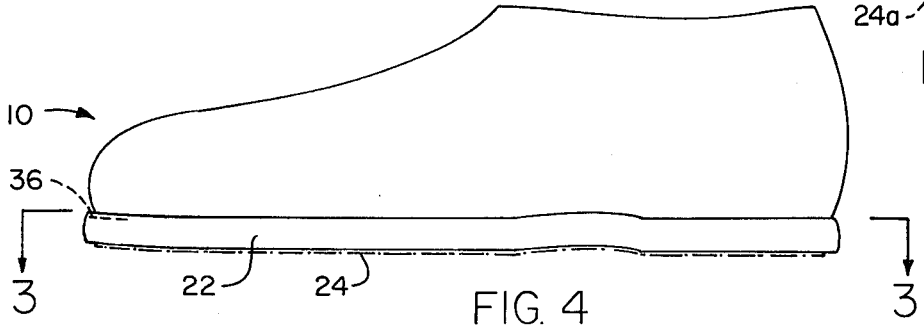
FIG. 4 is an elevational view of the footwear.

FIG. 3 shows the appearance at schematic sectional detail taken at 3—3, FIG. 4. 38 represents cement bonding, or vulcanizing or other assembly fastening means. Trim ring 22 is visible, somewhat expanded for exposition.

FIG. 4 shows the finished article of footwear in side elevational view with trim ring 22 wrapped around the flap 36. Screen 24 shows, for exposition, below trim ring 22.

Figure 5:
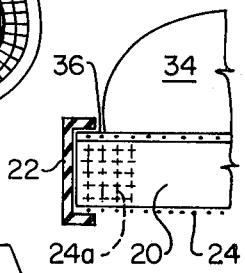
FIG. 5 is a fragmentary elevational detail, partly in section, and on a larger scale.

FIG. 5 shows in fragmentary detail the trim ring 22, screen 24, 24*a*, sole 20 and flap 36, as amended.

Diameter of the individual wires may be 0.0095 inch (0.24 mm) and the mesh may be 15 by 18 to the inch (6 by 7 to the centimeter).

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In footwear of the type which flexes as the user walks and which has: a vamp, a sole which flexes during said walking and has a top, upright sides and bottom with heel and toe areas, means for assembling the vamp and sole; and wire mesh type means for preventing slipping, attached at the sole; the improvement comprising: the wire mesh type means for preventing slipping including: the bottom of the sole having thereon a substantially loose covering of aluminum flyscreen for shedding ice and snow from the bottom of the footwear, including attachment of the substantially loose covering of aluminum flyscreen permitting flexing the substantially loose covering of aluminum flyscreen in response to flexure of said sole, said substantially loose covering of aluminum flyscreen attached around the upright sides of said sole but being free of attachment to the bottom of the sole, means on said substantially loose covering of aluminum flyscreen for maintaining traction on smooth, hard tile floors and the like, and said attachment around the upright sides comprising said substantially loose covering of aluminum flyscreen having connective portions extending up around said upright sides and on the top of a flap portion of said sole extending horizontally around said vamp.

2. In footwear of the type which flexes as the user walks and which has: a vamp, a sole which flexes during said walking and has a top, upright sides and bottom with heel and toe areas, means for assembling the vamp and sole; and wire mesh type means for preventing slipping, attached at the sole; the improvement comprising: the wire mesh type means for preventing slipping including: the bottom of the sole having thereon a substantially loose covering of aluminum flyscreen for shedding ice and snow from the bottom of the footwear including attachment of the substantially loose covering of aluminum flyscreen permitting flexing the substantially loose covering of aluminum flyscreen in response to flexure of said sole, said substantially loose covering of aluminum flyscreen attached around the upright sides of said sole but being free of attachment to the bottom of the sole, means around said substantially loose covering of aluminum flyscreen for maintaining traction on smooth, hard tile floors and the like, comprising a trim ring around said sole, said trim ring being of soft elastomeric material, the trim ring having a bottom edge, and said bottom edge of the trim ring protruding downward below said substantially loose covering of aluminum flyscreen.

3. In footwear of the type which flexes as the user walks and which has: a vamp, a sole which flexes during said walking and has a top, upright sides and bottom with heel and toe areas, means for assembling the vamp and sole; and wire mesh type means for preventing slipping, attached at the sole; the improvement comprising: the wire mesh type means for preventing slipping including: the bottom of the sole having thereon a substantially loose covering of aluminum flyscreen for shedding ice and snow from the bottom of the footwear, including attachment of the substantially loose covering of aluminum flyscreen permitting flexing the substantially loose covering of aluminum flyscreen in response to flexure of said sole, said substantially loose covering of aluminum flyscreen attached around the upright sides of said sole but being free of attachment to the bottom of the sole, means on said substantially loose covering of aluminum flyscreen for maintaining traction on smooth, hard tile floors and the like, comprising soft elastomeric material embedded upon a plurality of areas of said substantially loose covering of aluminum flyscreen.

4. In footwear as recited in claim 2, said soft elastomeric material protruding downwardly from the substantially loose covering of aluminum flyscreen.

5. In footwear as recited in claim 4, said soft elastomeric material being of material that remains soft when cold, such as "Silicone" rubber.

6. In footwear as recited in claim 5, said soft elastomeric material being free of attachment to the bottom of said sole.

7. In footwear as recited in claim 3, said plurality of areas including an arcuate area adjacent the heel area of the sole and a further arcuate area adjacent the toe area of the sole.

8. In footwear of the type which flexes as the user walks and which has: a vamp, a sole which flexes during said walking and has a top, upright sides and bottom with heel and toe areas, means for assembling the vamp and sole; and wire mesh type means for preventing slipping, attached at the sole; the improvement comprising: the wire mesh type means for preventing slipping including: the bottom of the sole having thereon a substantially loose covering of aluminum flyscreen for shedding ice and snow from the bottom of the footwear, including attachment of the substantially loose covering of aluminum flyscreen permitting flexing the substantially loose covering of aluminum flyscreen in response to flexure of said sole, said attachment permitting flexing including the substantially loose covering of aluminum flyscreen having said attachment around the upright sides of said sole but being free of attachment to the bottom of the sole, said attachment around the upright sides comprising said substantially loose covering of aluminum flyscreen having connective portions extending up around said upright sides and on the top of a flap portion of said sole extending horizontally around said vamp a trim ring of elastomeric material extending around and holding said upwardly extending connective portions, and said flap being secured inside said trim ring.

9. In footwear as recited in claim 1, a trim ring of elastomeric material extending around and holding said upwardly extending connective portions.

10. In footwear as recited in claim 9, a flap extending horizontally around said vamp, and said flap, on said assembly, being secured inside said trim ring.

* * * * *